US009256191B2

(12) United States Patent
Souda

(10) Patent No.: US 9,256,191 B2
(45) Date of Patent: Feb. 9, 2016

(54) IMAGE FORMING APPARATUS HAVING REDUCED HEIGHT

(71) Applicant: Makoto Souda, Nagoya (JP)

(72) Inventor: Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/096,375

(22) Filed: Dec. 4, 2013

(65) Prior Publication Data

US 2014/0178095 A1 Jun. 26, 2014

(30) Foreign Application Priority Data

Dec. 26, 2012 (JP) ..... 2012-282896

(51) Int. Cl.
*G03G 15/00* (2006.01)
*G03G 21/12* (2006.01)

(52) U.S. Cl.
CPC ..... *G03G 21/12* (2013.01)

(58) Field of Classification Search
CPC ..... G03G 21/10; G03G 21/12
USPC ..... 399/110, 123, 360, 391, 393
See application file for complete search history.

(56) References Cited

U.S. PATENT DOCUMENTS

| | | | | |
|---|---|---|---|---|
| 5,250,997 | A | 10/1993 | Kaneko et al. | |
| 6,078,762 | A * | 6/2000 | Fuchiwaki et al. | 399/94 |
| 7,965,973 | B2 | 6/2011 | Kawamoto | |
| 8,233,817 | B2 | 7/2012 | Sakuma | |
| 8,270,869 | B2 | 9/2012 | Sakuma | |
| 8,457,518 | B1 | 6/2013 | Sakuma | |
| 2006/0002735 | A1 * | 1/2006 | Tamaru et al. | 399/111 |
| 2006/0140669 | A1 * | 6/2006 | Sato | 399/110 |
| 2009/0052961 | A1 | 2/2009 | Kawamoto | |
| 2009/0080947 | A1 * | 3/2009 | Suzuki et al. | 399/302 |
| 2009/0196652 | A1 | 8/2009 | Sakuma | |
| 2009/0214274 | A1 * | 8/2009 | Maeda | 399/313 |
| 2010/0028041 | A1 | 2/2010 | Sakuma | |
| 2010/0074646 | A1 | 3/2010 | Miyahara et al. | |
| 2010/0209157 | A1 | 8/2010 | Sato et al. | |
| 2011/0236054 | A1 * | 9/2011 | Mori | G03G 15/0131 399/101 |
| 2012/0134727 | A1 | 5/2012 | Yamaguchi et al. | |
| 2012/0224883 | A1 | 9/2012 | Okano et al. | |

(Continued)

FOREIGN PATENT DOCUMENTS

| | | | |
|---|---|---|---|
| JP | H04-215668 | A | 8/1992 |
| JP | H05-249866 | A | 9/1993 |
| JP | H05-257340 | A | 10/1993 |

(Continued)

*Primary Examiner* — David Gray
*Assistant Examiner* — Thomas Giampaolo, II
(74) *Attorney, Agent, or Firm* — Banner & Witcoff, Ltd.

(57) ABSTRACT

An image forming apparatus has a compact size in height. The apparatus includes a main frame, a plurality of image forming components arrayed in the main frame in an array direction to form an image, a belt extending in the array direction and in contact with the plurality of image forming components, a first sheet accommodating portion configured to accommodate therein a recording sheet, and extending in the array direction and positioned below the belt, a collection member disposed in contact with the belt and configured to collect developing agent on the belt, and a container configured to hold the developing agent collected by the collection member. The container is positioned below the belt such that the container is juxtaposed with the first sheet accommodating portion in the array direction.

19 Claims, 3 Drawing Sheets

(56) References Cited

U.S. PATENT DOCUMENTS

| | | | |
|---|---|---|---|
| 2012/0269536 | A1 | 10/2012 | Sakuma |
| 2013/0121728 | A1 | 5/2013 | Sakuma |

FOREIGN PATENT DOCUMENTS

| | | | |
|---|---|---|---|
| JP | H08-030161 | A | 2/1996 |
| JP | H10-171196 | A | 6/1998 |
| JP | 2004-279919 | A | 10/2004 |
| JP | 2009-053314 | A | 3/2009 |
| JP | 2009-053409 | A | 3/2009 |
| JP | 2009-181077 | A | 8/2009 |
| JP | 2010-038947 | A | 2/2010 |
| JP | 2010-191012 | A | 9/2010 |
| JP | 2011-017939 | A | 1/2011 |
| JP | 2012-118175 | A | 6/2012 |
| JP | 2012-194539 | A | 10/2012 |

* cited by examiner

IMAGE FORMING APPARATUS HAVING REDUCED HEIGHT

CROSS REFERENCE TO RELATED APPLICATION

This application claims priority from Japanese Patent Application No. 2012-282896 filed Dec. 26, 2012, the entire content of which is incorporated herein by reference.

TECHNICAL FIELD

The present invention relates to an image forming apparatus provided with a belt cleaner for cleaning a belt.

BACKGROUND

A conventional image forming apparatus is provided with a belt cleaner. More specifically, the image forming apparatus has a belt in contact with a photosensitive body, and the belt cleaner is adapted to collect toner deposited on the belt. The belt cleaner positioned immediately below and in contact with the belt which is positioned above a sheet supply tray or a sheet cassette. That is, the belt cleaner is positioned between the sheet supply tray and the belt.

SUMMARY

With such a conventional structure, a main frame accommodating these components must be bulky in height.

In view of the foregoing, it is an object of the present invention to provide an image forming apparatus having a reduced height.

This and other object of the present invention will be attained by providing an image forming apparatus including a main frame, a plurality of image forming components, a belt, a first sheet accommodating portion, a collection member, and a container. The plurality of image forming components is arrayed in the main frame in an array direction and is configured to form an image with a developing agent. The belt extends in the array direction and is in contact with the plurality of image forming components. The first sheet accommodating portion is configured to accommodate a first sheet. The first sheet accommodating portion extends in the array direction and is positioned below the belt. The collection member is disposed in contact with the belt and configured to collect developing agent on the belt. The container is configured to hold the developing agent collected by the collection member. The container is positioned below the belt such that the container is juxtaposed with the first sheet accommodating portion in the array direction.

According to another aspect, the present invention will be attained by providing an image forming apparatus including a main frame, a plurality of image forming components, a conveyer belt, a first sheet accommodating portion, and a belt cleaner. The plurality of image forming components is arrayed in the main frame in an array direction and configured to form an image with a developing agent. The conveyer belt is configured to convey a recording sheet. The conveyer belt extends in the array direction and is in contact with the image forming component. The first sheet accommodating portion is configured to accommodate therein the recording sheet. The first sheet accommodating portion extends in the array direction and is positioned opposite to the image forming component with respect to the conveyer belt. The belt cleaner is configured to collect developing agent on the conveyer belt.

The belt cleaner is positioned to be juxtaposed with the first sheet accommodating portion in the array direction.

DETAILED DESCRIPTION

Figure 1:
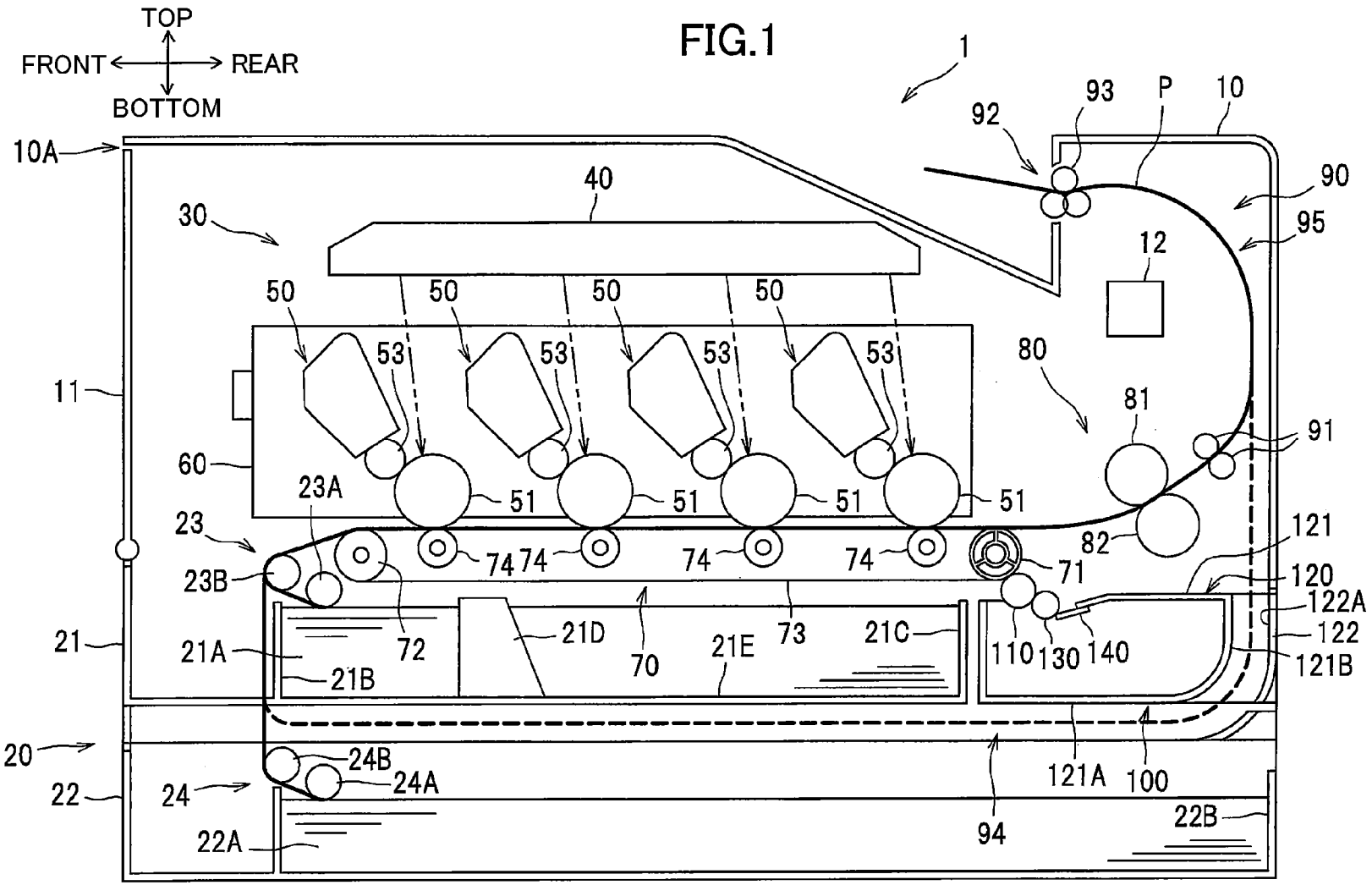
FIG. 1 is a schematic view of a color printer according to one embodiment of the present invention.

An image forming apparatus according to one embodiment of the present invention will be described with reference to FIGS. 1 through 3. As the image forming apparatus, an electro-photographic type color printer 1 will be described. In the following description, the terms "upward", "downward", "upper", "lower", "above", "below", "beneath", "right", "left", "front", "rear" and the like will be used assuming that the color printer 1 is disposed in an orientation in which it is intended to be used. In use, the printer 1 is disposed as shown in FIG. 1, in which left side and right sides of the drawing will be referred to as "front side" and "rear side" of the printer, respectively.

[Overall Structure of the Color Printer]

As shown in FIG. 1, the printer 1 includes a main frame 10 which accommodates therein a sheet supply unit 20 for supplying a sheet P, an image forming unit 30 for forming an image on the sheet supplied from the sheet supply unit 20, a sheet discharge unit 90 for discharging the sheet on which an image is formed, and a power unit 12. The main frame 10 has a front end portion which defines an opening 10A. Further, a front cover 11 is pivotally movably provided at the front end portion for covering the opening 10A and for opening the opening 10A.

The sheet supply unit 20 includes a first sheet supply tray 21 for accommodating a first sheet stack, a second sheet supply tray 22 for accommodating a second sheet stack, a first sheet convey unit 23 for conveying a first sheet from the first sheet supply tray 21 to the image forming unit 30, and a second sheet convey unit 24 for conveying a second sheet from the second sheet supply tray 22 to the image forming unit 30.

The first sheet supply tray 21 is positioned at a lower portion of the main frame 10 and extends in frontward/rearward direction, and defines a first sheet accommodating portion 21A configured to accommodates therein a stack of the first sheet P such as letter sized sheets.

The first sheet accommodating portion 21A is a space defined by surrounding walls. That is, as shown in FIG. 3, the first sheet accommodating portion 21A is defined by a front wall 21B configured to regulate each leading edge position of each first sheet P, a rear wall 21C configured to regulate each trailing edge position of each first sheet P, a pair of side guides 21D configured to regulate each lateral edge position of each first sheet P, and a bottom wall 21E on which a lowermost sheet of the first sheet stack is mounted. A volume of the first sheet accommodating portion 21A is determined by an upper surface of the bottom wall 21E and a height of a specific one of the walls having the lowest height from the upper surface of the bottom wall 21E to an upper end of the specific one of the walls. For example, in the depicted embodiment, the specific one of the walls is one of the front wall 21B and the rear wall 21C.

Figure 2:
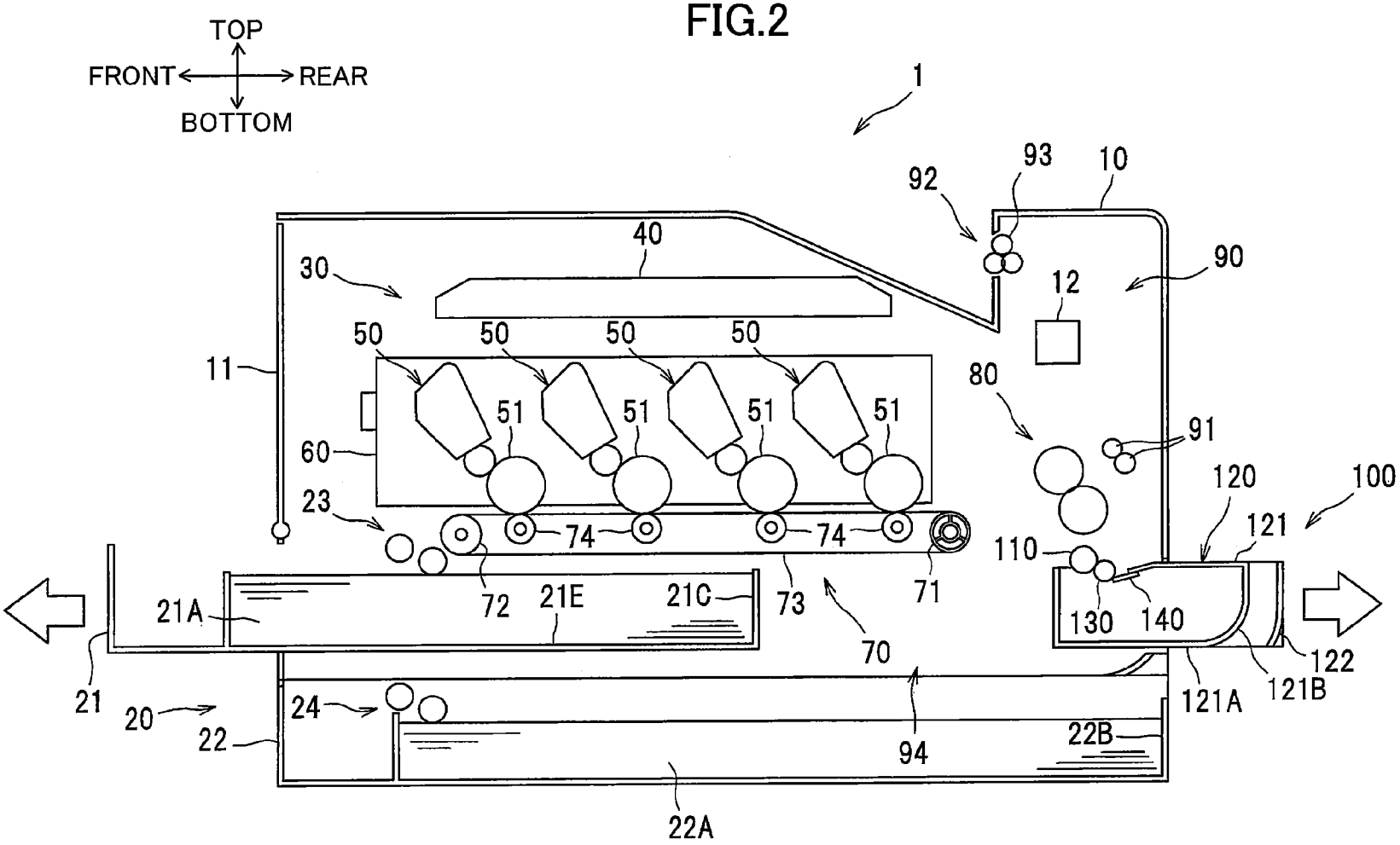
FIG. 2 is a schematic view of the color printer having a first sheet supply tray and a belt cleaner those being pulled out of a main frame according to the embodiment.
Figure 3:
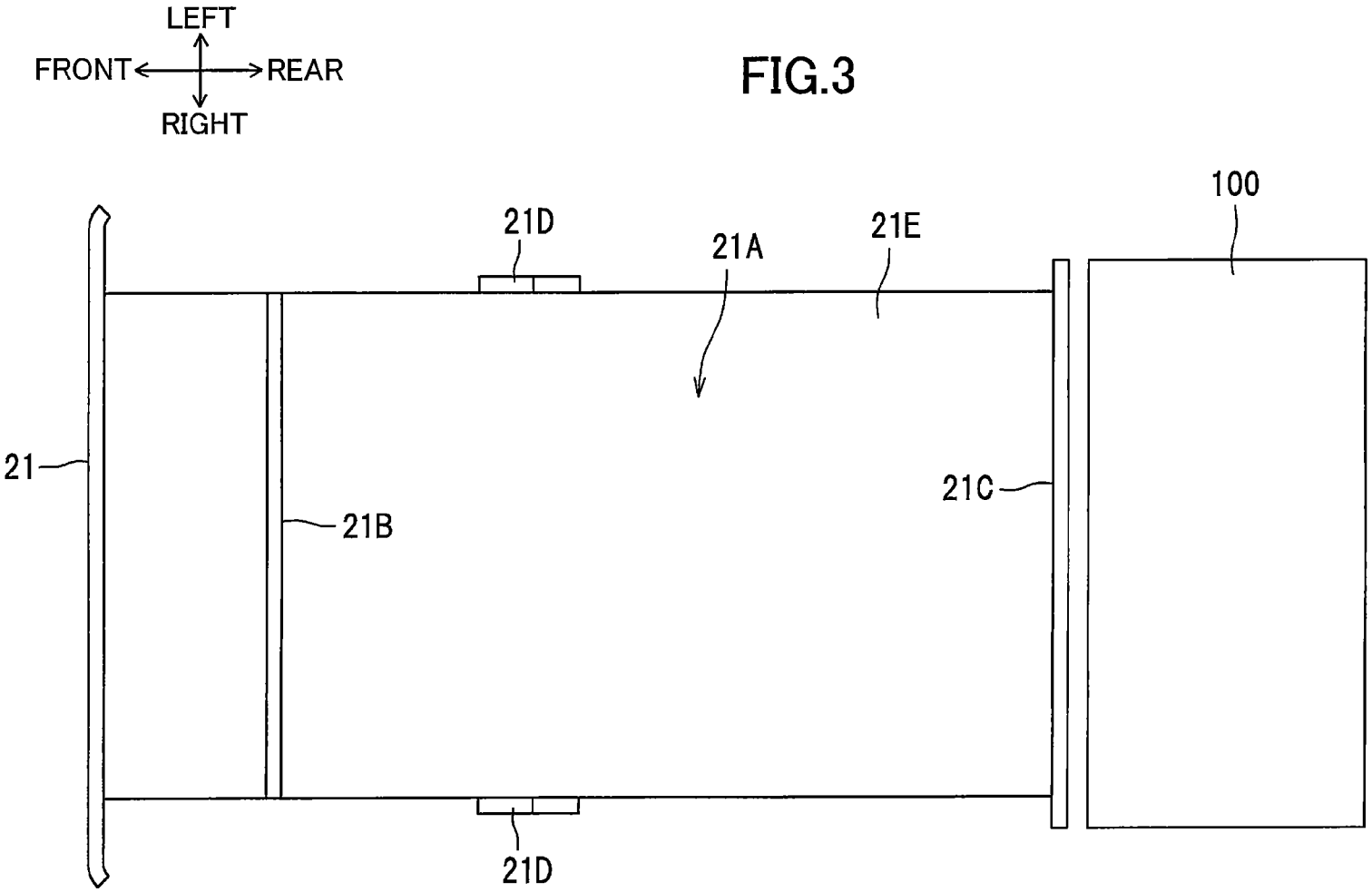
FIG. 3 is a plan view of the first sheet supply tray and the belt cleaner in the color printer according to the embodiment.

As shown in FIG. 2, the first sheet supply tray 21 can be pulled out of the main frame 10 by moving the first sheet supply tray 21 frontward with respect to the main frame 10.

As shown in FIG. 1, the second sheet supply tray 22 is positioned below the first sheet supply tray 21, and extends in the frontward/rearward direction. The second sheet supply tray 22 defines a second sheet accommodating portion 22A configured to accommodates therein a stack of the second sheet P such as legal size sheets having a length greater than that of the first sheet P. That is, the second sheet supply tray 22 has a length greater than that of the first sheet supply tray 21 such that a rear end of the second sheet supply tray 22 is positioned rearward of a rear end of the first sheet supply tray 21.

The second sheet accommodating portion 22A is a space defined by surrounding walls in a manner similar to the first sheet accommodating portion 21A for accommodating therein the second sheet P. One of the surrounding walls is a rear wall 22B positioned rearward of the rear wall 21C of the first sheet supply tray 21.

Similar to the first sheet supply tray 21, the second sheet supply tray 22 can be pulled out of the main frame 10 by moving the second sheet supply tray 22 frontward with respect to the main frame 10.

The first sheet convey unit 23 includes a first pick-up roller 23A and a first conveyer roller 23B. The first pick-up roller 23A is positioned in contact with a front end portion of a first sheet P accommodated in the first sheet accommodating portion 21A, and is configured to feed the first sheet P in the first sheet accommodating portion 21A out of the first sheet supply tray 21. The first conveyer roller 23B is positioned downstream of the first pick-up roller 23A in a sheet conveying direction and configured to feed the first sheet P fed by the first pick-up roller 23A toward the image forming unit 30.

The second sheet convey unit 24 includes a second pick-up roller 24A and a second conveyer roller 24B. The second pick-up roller 24A is positioned in contact with a front end portion of a second sheet P accommodated in the second sheet accommodating portion 22A, and is configured to feed the second sheet P in the second sheet accommodating portion 22A out of the second sheet supply tray 22. The second conveyer roller 24B is positioned downstream of the second pick-up roller 24A in the sheet conveying direction and configured to feed the second sheet P fed by the second pick-up roller 24A toward the first conveyer roller 23B of the first sheet convey unit 23. That is, the second sheet P in the second sheet supply tray 22 is conveyed to the image forming unit 30 by way of the first conveyer roller 23B of the first sheet convey unit 23.

The image forming unit 30 includes a scanner unit 40, four process cartridges 50, a drawer 60, a transfer unit 70, a fixing unit 80 and a belt cleaner 100.

The process cartridges 50 are positioned above the sheet supply unit 20 and are arrayed in the frontward/rearward direction. Each process cartridge 50 includes a photosensitive drum 51, a developing roller 53, a toner chamber for accommodating therein a toner as a developing agent, and a charger (not shown).

The scanner unit 40 is positioned at an upper internal portion of the main frame 10, and includes a laser emitting portion, a polygon mirror, lenses, and a reflection mirror those not shown. The scanner unit 40 is adapted to emit scanning laser beam, such that each outer peripheral surface of each photosensitive drum 51 is exposed to the beam that runs through pathways indicated by two dotted chain lines in FIG. 1.

The drawer 60 is configured to hold the four process cartridges 50, and can be pulled out of the main frame 10 through the opening 10A after opening the front cover 11 in the frontward/rearward direction.

The transfer unit 70 is positioned between the sheet supply unit 20 and the array of the process cartridges 50, and includes a drive roller 71, a driven roller 72, a conveyer belt 73, and four transfer rollers 74.

The drive roller 71 and the driven roller 72 are spaced away from each other in the direction of array of the four photosensitive drums 51 and extend in parallel to each other. The conveyer belt 73 is mounted on these rollers 71, 72 under tension. That is, the conveyer belt 73 is stretched in the frontward/rearward direction or the direction of the array of the photosensitive drums 51. The conveyer belt 73 has an outer surface in contact with each photosensitive drum 51. The transfer rollers 74 are positioned in an internal space of the conveyer belt 73, and each of the transfer rollers 74 is positioned in contact with each of the photosensitive drums 51, such that the conveyer belt 73 is nipped between each transfer roller 74 and each photosensitive drum 51. Each transfer roller 74 is configured be applied with a transfer bias by constant current control during image transfer.

The belt cleaner 100 is positioned below the conveyer belt 73 and in contact with the conveyer belt 73 for collecting toner deposited thereon. Further, the belt cleaner 100 is positioned rearward of the first sheet supply tray 21 and above the second sheet supply tray 22. The belt cleaner 100 includes a cleaning roller 110 as a collection member, a waste toner container 120, a collection roller 130, and a blade 140.

The cleaning roller 110 is positioned in contact with the outer surface of the conveyer belt 73, and is applied with a collection bias for collecting waste toner deposited on the conveyer belt 73. The collection roller 130 is in contact with the cleaning roller 110 for receiving the collected waste toner from the cleaning roller 110. The blade 140 is in sliding contact with the collection roller 130 for scraping off the waste toner collected on the collection roller 130. Thus, the waste toner is collected in the waste toner container 120.

The fixing unit 80 is positioned rearward of the process cartridge 50 and the transfer unit 70, and includes a heat roller 81 and a pressure roller 82 facing and pressing the heat roller 81.

The sheet discharge unit 90 includes feed rollers 91, discharge roller 93, and a guide (not shown). The feed rollers 91 are adapted to feed the sheet P delivered from the fixing unit 80. The main frame 10 is formed with a discharge opening 92 opening frontward and positioned above the fixing unit 80. The discharge rollers 93 are adapted to discharge the sheet P out of the main frame 10 through the discharge opening 92. The guide is adapted to guide the sheet P to be movable along a U-shaped passage from the fixing unit 80 to the discharge opening 92. These feed rollers 91, the discharge rollers 93, and the guide provide in combination a U-shaped discharge passage 95 along which the sheet P that has been subjected to printing the image forming unit 30 is moved to an outside of the main frame 10.

A recirculation passage 94 is branched from the discharge passage 95 for returning a printed sheet P at the discharge passage 95 to an upstream side of the image forming unit 30 in the sheet conveying direction. The recirculation passage 94 is provided by a guide and a plurality of rollers, those not shown, and extends downward from a discharge passage portion downstream of the feed rollers 91 and then is bent frontward to extend along and below the first sheet supply tray 21, and is bent upward to extend to the first conveyer roller 23B of the first sheet convey unit 23.

The power unit 12 is connected to a commercially available AC source, and is positioned above the fixing unit 80. The power unit 12 is a conventional power supply device for supplying, through DC voltage conversion, an electric power to each component of the color printer 1.

In the image forming unit 30, each surface of each photosensitive drum 51 subjected to scanning by the scanner unit 40, after each surface of each photosensitive drum 51 is uniformly charged by the charger, whereupon charge of the exposed region is erased to provide an electrostatic latent image based on image data on each surface. Then, a visible toner image is formed on each surface of each photosensitive drum 51 by the toner supplied to the electrostatic latent image from the toner chamber through the developing roller 53.

Then, each toner image formed on each photosensitive drum 51 is successively transferred onto a sheet P each time the sheet P on the conveyer belt 73 passes through a gap between each photosensitive drum 51 and each transfer roller 74. Thereafter, the toner image formed on the sheet P is thermally fixed to the sheet P when the sheet P passes through the heat roller 81 and the pressure roller 82.

In case of one-side printing in the sheet discharge unit 90, the sheet P fed from the fixing unit 80 makes a U-turn along the discharge passage 95 to head toward the outside of the main frame 10 through the discharge opening 92. On the other hand, in case of both side printing, the sheet P subjected to one-side printing is partially conveyed out of the main frame 10 by the discharge roller 93, and then the discharge roller 93 is reversely rotated to reversely feed the sheet P toward the recirculation passage 94. Thus, the sheet P is supplied to the upstream side of the image forming unit 30 for printing an image on an unprinted side of the sheet P.

[Details of Color Printer]

Details of the color printer 1, in particular, the transfer unit 70 and the belt cleaner 100 will next be described.

The driven roller 72 of the transfer unit 70 is positioned inward of the front end of the first sheet accommodating portion 21A of the first sheet supply tray 21 with respect to an internal space of the main frame 10. More specifically, the driven roller 72 is positioned rearward of the first pick-up roller 23A. Further, the driven roller 72 is partially overlapped with the first pick-up roller 23A in height when viewed from the frontward/rearward direction. Further, the drive roller 71 of the transfer unit 70 is positioned rearward of the rear wall 21C of the first sheet supply tray 21. The front wall 21B of the first sheet supply tray 21 is positioned frontward of the conveyer belt 73 in the frontward/rearward direction.

With such positions of the drive and driven rollers 71 and 72, the conveyer belt 73 stretchingly mounted between the drive and driven rollers 71 and 72 extends from a position rearward of the front end of the first sheet accommodating portion 21A to a position rearward of the rear end of the first sheet accommodating portion 21A. Further, the first pick-up roller 23A is positioned outward of the conveyer belt 73 with respect to the internal space of the main frame 10, and is partially overlapped with the conveyer belt 73 in height when viewed from the frontward/rearward direction.

As shown in FIG. 1, the belt cleaner 100 is positioned adjacent to and rearward of the first sheet accommodating portion 21A, and is partially overlapped with the first sheet accommodating portion 21A in height when viewed from the frontward/rearward direction. That is, the belt cleaner 100 is partially overlapped with a vertical height of the first sheet supply tray 21 ranging from the bottom wall 21E to the upper end of the rear wall 21C. The belt cleaner 100 is separated from the scanner unit 40, the drawer 60, and the first sheet accommodating portion 21A in the frontward/rearward direction, i.e., the belt cleaner 100 is shifted rearward relative to the scanner unit 40, the drawer 60, and the first sheet accommodating portion 21A when viewed from the vertical direction. The belt cleaner 100 is separated from the belt 73 in the vertical direction, i.e., the belt cleaner 100 is shifted downward relative to the belt 73 when viewed from the frontward/rearward direction.

The cleaning roller 110 is in contact with the rear end portion of the conveyer belt 73 from below, such that the conveyer belt 73 is nipped between the drive roller 71 and the cleaning roller 110. The cleaning roller 110 is overlapped with the drive roller 71 and the belt 73 in height when viewed from the frontward/rearward direction. Specifically, the cleaning roller 110 contacts the conveyer belt 73 at a contact portion thereof which is overlapped with the conveyer belt 73 in the vertical and frontward/rearward direction. The cleaning roller 110 is rotated in a direction opposite to the rotating direction of the drive roller 71 and is applied with a collection bias so as to collect toner remaining on the conveyer belt 73.

The waste toner container 120 includes a container body 121 for collecting a waste toner therein, and a guide portion 122 provided integrally with the container body 121. In the same manner as belt cleaner 100, the waste toner container 120 is partially overlapped with the first sheet accommodating portion 21A in height when viewed from the frontward/rearward direction. That is, the waste toner container 120 is juxtaposed with the first sheet accommodating portion 21A in the frontward/rearward direction.

The container body 121 is positioned between a rear portion of the second sheet accommodating portion 22A and the fixing unit 80, these being arrayed in the vertical direction. The container body 121 has a bottom surface 121A defining a part of the recirculation passage 94 for guiding the sheet P conveyed therethrough.

The cleaning roller 110 is rotatably supported to the container body 121 having an upper opening through which the cleaning roller 110 is exposed to the conveyer belt 73. Since the cleaning roller 110 is provided to the container body 121, a conveying passage for conveying waste toner collected by the cleaning roller 110 to the container body 121 is not required, thereby simplifying an entire structure.

Incidentally, excessive heating to the waste toner collected in the container body 121 can be restrained even if the container body 121 is positioned vertically below the fixing unit 80, since heat generated at the fixing unit 80 can be escaped upward. Thus, offsetting positioning in the frontward/rearward direction between the fixing unit 80 and the belt cleaner 100 is unnecessary, thereby reducing length of the main frame 10 in the frontward/rearward direction.

The guide portion 122 is positioned rearward of the container body 121, and defines a part of the recirculation passage 94 in cooperation with a rear wall of the container body 121. The container body 121 has a rear surface 121B and the guide portion 122 has a front surface 122A, these surfaces 121B and 122A functioning as guide surfaces for guiding the sheet P conveyed in the recirculation passage 94.

The belt cleaner 100 can be pulled out rearward from the main frame 10 as shown in FIG. 2.

The above-described embodiment provides advantages as follows. Since the belt cleaner 100 in its entirety is positioned rearward of the first sheet supply tray 21, the first sheet supply tray 21 and the transfer unit 70 can be positioned closed to each other in comparison with a case where the belt cleaner is positioned between the first sheet supply tray and the transfer unit. Further, the belt cleaner 100 is positioned at a vertical height equal to that of the first sheet supply tray 21, and therefore, the main frame 10 can have a reduced height.

Further, a space can be provided at the upper rear portion of the second sheet accommodating portion 22A because of the difference in length in the frontward/rearward direction between the first sheet accommodating portion 21A and the second sheet accommodating portion 22A, so that the belt cleaner 100 can be provided at the space. That is, the belt cleaner 100 and at least a part of the second sheet accommodating portion 22A are overlapped with each other in the vertical direction. Accordingly, the belt cleaner 100 can be positioned at a vertical level equal to that of the first sheet accommodating portion 21A without elongation of the main frame 10 in the vertical direction.

Further, the first pick-up roller 23A is positioned relatively frontward of the conveyer belt 73, and at a vertical level substantially equal to that of the conveyer belt 73. Therefore, the sheet supply tray 21 and the transfer unit 70 can be positioned close to each other, thereby reducing a height of the main frame 10.

Further, the first sheet supply tray 21 positioned frontward of the belt cleaner 100 can be pulled out of the main frame 10 by pulling the first sheet supply tray 21 frontward. Thus, the first sheet supply tray 21 can be pulled out without mechanical interference with the belt cleaner 100 without removal of the belt cleaner 100 from the main frame 10.

Further, the belt cleaner 100 positioned rearward of the first sheet supply tray 21 can be pulled out of the main frame 10 by pulling the belt cleaner 100 rearward. Thus, the belt cleaner 100 can be pulled out without mechanical interference with the first sheet supply tray 21 without removal of the first sheet supply tray 21 from the main frame 10.

Further, since the belt cleaner 100 is positioned opposite to the first pick-up roller 23A with respect to the first sheet accommodating portion 21A, a structure for providing the sheet passage can be simplified in comparison with a case where the belt cleaner is positioned at a side the same as that of the first pick-up roller with respect to the first sheet accommodating portion.

Further, since the bottom surface 121A and the rear surface 121B of the container body 121 and the guide portion 122 define the part of the recirculation passage 94, a simplified main frame 10 can be provided in comparison with a case where a guide surface for defining the part of the recirculation passage 94 is provided separately from the belt cleaner.

Further, the cleaning roller 110 can be positioned offset from the first sheet accommodating portion 21A in the vertical direction, thereby reducing the height of the printer 1 and thus minimizing the size thereof. Further, the first pick-up roller 23A is offset from the conveyer belt 73 in the frontward/rearward direction, reducing the size of the printer 1. Further, since the second sheet accommodating portion 22A has a length in the frontward/rearward direction larger than that of the first sheet accommodating portion 21A, the second sheet accommodating portion 22A can accommodate therein a sheet which cannot accommodate in the first sheet accommodating portion 21A.

Various modifications are conceivable. For example, instead of the cleaning roller 110 as the collection member, a blade whose tip end is in contact with the conveyer belt 73 is available.

Further, in the depicted embodiment, the belt cleaner 100 is pulled out of the main frame 10 by rearward movement of the belt cleaner 100. However, leftward or rightward movement of the belt cleaner is conceivable for pulling the belt cleaner out of the main frame. In the latter case, the belt cleaner can be pulled out of the main frame without mechanical interference with the first sheet supply tray 21. Alternatively, the belt cleaner can be pivotally movable outward relative to the main frame 10, such that the belt cleaner can be moved out of the main frame 10.

Further, in the above-described embodiment, the electro photographic type image forming apparatus provided with the photosensitive drums 51 is provided with using a toner as developing agent. However, an ink jet type printer provided with an ink jet head that ejects ink droplet for forming an image is also available in the present invention.

While the invention has been described in detail with reference to the above-described embodiments thereof, it would be apparent to those skilled in the art that various changes and modifications may be made therein without departing from the spirit of the invention.

What is claimed is:

1. An image forming apparatus comprising:

a main frame defining a discharge opening;

a plurality of image forming components arrayed in the main frame in an array direction and configured to form an image with a developing agent;

a belt extending in the array direction and in contact with the plurality of image forming components;

a first sheet accommodating portion configured to accommodate therein a recording sheet, the first sheet accommodating portion extending in the array direction and positioned below the belt;

a collection member disposed in contact with the belt and configured to collect developing agent on the belt;

a container configured to hold the developing agent collected by the collection member, the container being positioned below the belt such that the container is juxtaposed with the first sheet accommodating portion in the array direction, a conveying passage extending from the plurality of image forming components to the discharge opening to convey a recording sheet; and a recirculation passage having a part positioned below the first sheet accommodating portion to convey a recording sheet on which the image has been formed toward the image forming components, the container being positioned between the conveying passage and the recirculation passage in a vertical direction, the container having a guide surface defining a part of the recirculating passage.

2. The image forming apparatus as claimed in claim 1, wherein the first sheet accommodating portion is movable relative to the main frame in a first direction away from the container.

3. The image forming apparatus as claimed in claim 2, wherein the container is movable relative to the main frame in a direction different from the first direction.

4. The image forming apparatus as claimed in claim 1, wherein the belt has a part positioned to overlap with the container in the vertical direction.

5. The image forming apparatus as claimed in claim 4, wherein the collection member is in contact with the part.

6. The image forming apparatus as claimed in claim 1, wherein the collection member is supported to the container.

7. The image forming apparatus as claimed in claim 1, further comprising a pick-up roller configured to feed a recording sheet accommodated in the first sheet accommodating portion, the container being positioned opposite to the pick-up roller with respect to the first sheet accommodating portion.

8. The image forming apparatus as claimed in claim 7, wherein the first sheet accommodating portion has an end portion opposite to the container in the array direction, the end portion being positioned outward of the belt in the array direction, wherein the container is positioned opposite to the pick-up roller with respect to the first sheet accommodating portion.

9. The image forming apparatus as claimed in claim 8, wherein the pick-up roller is positioned to overlap with the belt in the array direction.

10. The image forming apparatus as claimed in claim 1, further comprising a second sheet accommodating portion positioned below the first sheet accommodating portion, the second sheet accommodating portion and the container being overlapped with each other in the vertical direction.

11. The image forming apparatus as claimed in claim 10, wherein the second sheet accommodating portion is longer than the first sheet accommodating portion in the array direction, wherein the belt is configured to convey the recording sheet in a conveying direction, wherein the container is positioned above the second sheet accommodating portion and at a downstream side of the first sheet accommodating portion in the conveying direction.

12. The image forming apparatus as claimed in claim 1, further comprising a fixing unit configured to thermally fix to the recording sheet the developing agent formed on the recording sheet by the image forming components, the container being positioned below the fixing unit and overlapped therewith in the vertical direction.

13. The image forming apparatus as claimed in claim 12, further comprising a power unit configured to supply an electric power and positioned opposite to the container with respect to the fixing unit.

14. The image forming apparatus as claimed in claim 1, further comprising:

a fixing unit configured to thermally fix to the recording sheet the developing agent formed on the recording sheet by the image forming components.

15. The image forming apparatus as claimed in claim 1, further comprising a drawer configured to accommodate therein the plurality of image forming components and be pulled out from the main frame in the array direction, wherein the container is separated from the drawer when viewed from the vertical direction.

16. The image forming apparatus as claimed in claim 1, further comprising an exposure unit configured to expose each of the plurality of image forming components, wherein the container is separated from the exposure unit when viewed from the vertical direction.

17. The image forming apparatus as claimed in claim 1, wherein the container is separated from the first sheet accommodating portion when viewed from the vertical direction.

18. The image forming apparatus as claimed in claim 1, wherein the container is separated from the belt when viewed from the array direction.

19. An image forming apparatus comprising:

a main frame;

a plurality of image forming components arrayed in the main frame in an array direction and configured to form an image with a developing agent;

a belt extending in the array direction and in contact with the plurality of image forming components;

a first sheet accommodating portion configured to accommodate therein a recording sheet, the first sheet accommodating portion extending in the array direction and positioned below the belt;

a collection member disposed in contact with the belt and configured to collect developing agent on the belt;

a container configured to hold the developing agent collected by the collection member, the container being positioned below the belt such that the container is juxtaposed with the first sheet accommodating portion in the array direction;

a fixing unit configured to thermally fix to the recording sheet the developing agent formed on the recording sheet by the image forming components; and a recirculation passage having a part positioned below the first sheet accommodating portion to convey a recording sheet on which the developing agent has been fixed by the fixing unit toward the image forming components, the container having a guide surface defining a part of the recirculation passage.

* * * * *